US005546711A

United States Patent [19]

Heller

[11] Patent Number: 5,546,711

[45] Date of Patent: Aug. 20, 1996

[54] BASE ISOLATOR FIRE BARRIER SYSTEM

[76] Inventor: Paul S. Heller, 14041 Mar Vista St., Whittier, Calif. 90602

[21] Appl. No.: 452,106

[22] Filed: May 26, 1995

[51] Int. Cl.[6] ..... F04H 9/02

[52] U.S. Cl. ..... 52/167.1; 52/167.7; 52/232; 52/167.4; 248/632; 248/638

[58] Field of Search ..... 52/167.1–167.7, 52/167.9, 232, 396.01; 248/632, 635, 638

[56] References Cited

U.S. PATENT DOCUMENTS

| | | | |
|---|---|---|---|
| 3,929,167 | 12/1975 | Bickel | 138/151 |
| 4,442,585 | 4/1984 | McGehee, Sr. et al. | 29/432 |
| 4,766,420 | 8/1988 | Hastings et al. | 340/550 |
| 5,038,693 | 8/1991 | Kourtides et al. | 428/285 X |

FOREIGN PATENT DOCUMENTS

| | | | |
|---|---|---|---|
| 1203542 | 8/1989 | Japan | 52/167.7 |
| 1263335 | 10/1989 | Japan | 52/167.7 |
| 0004049 | 1/1991 | Japan | 52/167.7 |
| 4029638 | 1/1992 | Japan | 52/167.7 |
| 6073809 | 3/1994 | Japan | 52/232 |

*Primary Examiner*—Carl D. Friedman
*Assistant Examiner*—Winnie Yip
*Attorney, Agent, or Firm*—Fulwider Patton Lee & Utecht

[57] ABSTRACT

A barrier system provides protection for isolators from fire and heat. Insulative panels are positioned about said isolator and are attached thereto and to one another in such a manner so as to allow the isolator to distort without compromising the barrier's ability to effectively shield the isolator.

16 Claims, 3 Drawing Sheets

FIG. 1
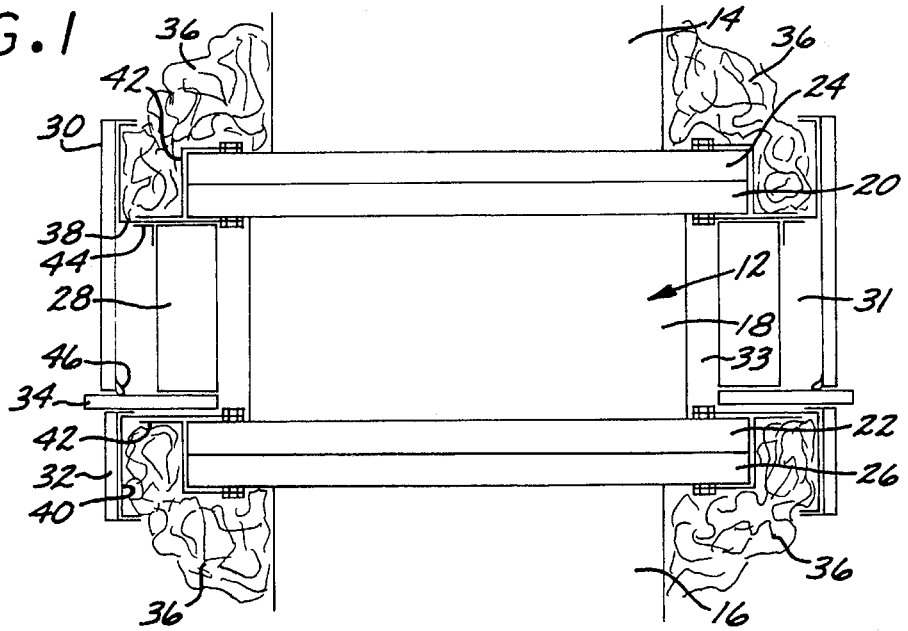
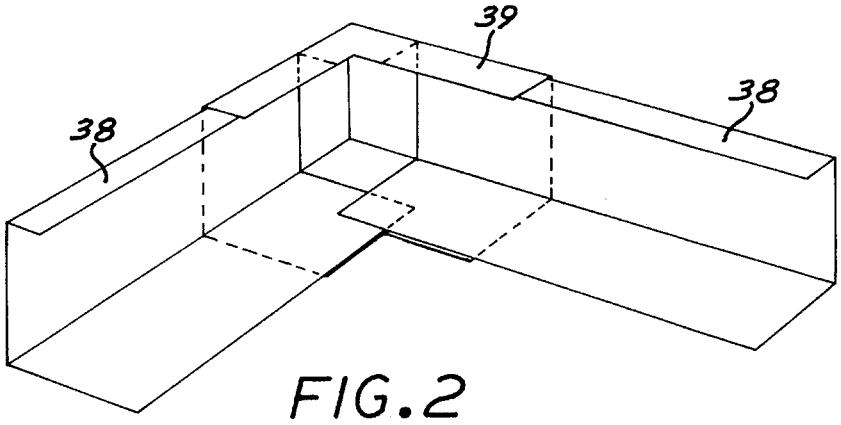
FIG. 2
FIG. 3
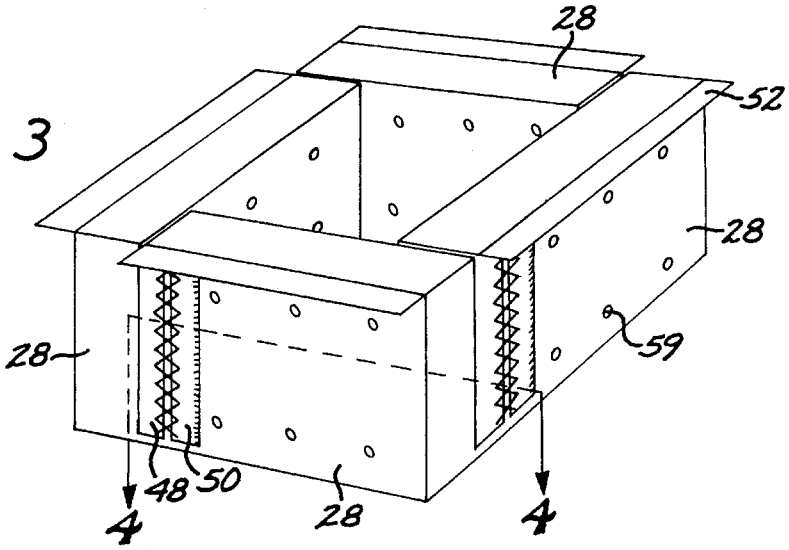

BASE ISOLATOR FIRE BARRIER SYSTEM

BACKGROUND

The present invention generally relates to barrier systems that are fitted to various structural components of a building in order to afford protection from fire and heat. More particularly, the invention pertains to providing such protection for the base isolators that serve to both support a structure and reduce the transfer of seismic loads thereto.

Many buildings that are located in seismically active regions have been fitted or retrofitted with base isolator bearings. A plurality of such devices are positioned beneath a building so as to bear the full weight of the building, each one being fitted between the foundation and the structure it supports. A type of isolator in common use today consists of a large mass of rubber or rubber-like material that is sandwiched in between and permanently affixed to two steel plates. One such plate is securely bolted or otherwise attached to either a column extending upwardly from the foundation or directly to the foundation of the building, while the opposite plate is rigidly affixed to the vertical support column extending upwardly therefrom. Although such device is able to support tremendous weight loads and withstand sizeable shear loads and displacements, it is quite susceptible to heat and fire damage by virtue of its elastomeric constitution. Failure of such a structurally essential component could, of course, have catastrophic consequences, and it is therefore necessary to adequately protect each isolator from fire and heat damage. Moreover, it would also be most advantageous for any such protective measures to continue to provide adequate protection upon substantial shear displacement of the isolator, as a seismic event causing such shear displacement often renders the risk of fire acute.

Both active, as well as passive, systems have heretofore been employed in an effort to provide thermal protection for isolator bearings. An example of an active system is one that provides for the irrigation of the isolators during a fire. Disadvantages inherent in such an approach include the need to rely on fire detection and valve actuation equipment and, most importantly, the fact that an adequate water supply may not be available after a seismic event. The passive systems have to date been limited to a simple wrapping or layering of insulative materials about the bearing. A critical shortcoming inherent in such configuration is its inability to maintain or regain its integrity and hence its insulative efficacy upon substantial displacements of the bearing. A need therefore exists for a passive insulation system that is substantially unaffected by shear displacement.

SUMMARY OF THE INVENTION

The present invention provides a fire barrier system for a base isolator that overcomes the shortcomings of the prior art. A combination of various insulative materials are interfitted around and about the isolator to provide the required insulative effect, while the configuration of the materials employed and the manner in which they are interconnected allows the isolator to undergo substantial distortion without compromise to the system's insulative function.

The system generally consists of an articulated insulative blanket that completely surrounds the isolator in a spaced relationship such that an air gap is maintained therebetween, a shelf extending radially from near the base of the isolator to provide a horizontal sealing surface, and a packing of insulative material above and below the blanket. An outer insulative wrapping that encases both the insulative blanket and packing may optionally be included. Both the inner insulative blanket, as well as the optional outer wrapping, are supported from above, while their lower edges sealingly engage the horizontal shelf, in a manner so as to be free to shift relative thereto. Upon distortion of the isolator, stresses that would otherwise buildup in the barrier are relieved by such relative movement thereby maintaining the insulative integrity of the device.

The inner blanket consists of a plurality of individual panels, each having flaps or tabs extending therefrom whereby steel wire lacing is used to interconnect flaps of adjacent panels. Each of the panels are made up of layers of ceramic fiber insulation enveloped in a skin of insulative material. The optional outer wrapping has a similar multilayer ceramic fiber core, additionally incorporating wire mesh therein and is enveloped by a skin of insulative material that is preferably aluminized on all outwardly facing surfaces.

These and other features and advantages of the present invention will become apparent from the following detailed description of a preferred embodiment which, taken in conjunction with the accompanying drawings, illustrates by way of example the principles of the invention.

BRIEF DESCRIPTION OF THE DRAWINGS

FIG. 1 is a cross sectional view illustrating the barrier system of the present invention in place about a base isolator;

FIG. 2 is an enlarged perspective view of a corner of the tray assembly;

FIG. 3 is a perspective view of four inner blanket panels interfitted to one another;

DETAILED DESCRIPTION OF PREFERRED EMBODIMENTS

Figure 4:
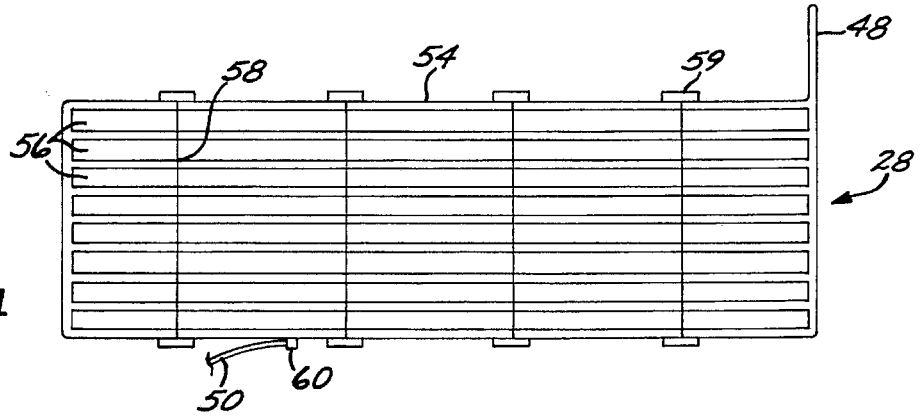
FIG. 4 is an enlarged cross sectional view of a section of inner blanket panel taken along lines 4—4 of FIG. 3.

The fire barrier system of the present invention protects a base isolator from heat and fire. Base isolators are utilized to provide support for a building while reducing the transfer of seismic loads thereto. The type of isolator for which the barrier system of the present invention is especially well suited comprises an elastomeric pad that is inserted under or in a concrete or steel vertical support column. Seismic displacements of the structure below the isolator causes the isolator to distort thereby reducing the actual loads imparted to structure above the isolator and may actually serve to effectively filter out oscillations of certain frequencies.

The dimensions of a base isolator are a function of many parameters including the size of the column it is to support, the static load exerted thereon, and the dynamic loads it is designed to withstand. For purposes of illustration only, an isolator capable of supporting a column 24" square exerting a static load of many hundreds of tons may be a square slab of rubber 12" thick having sides 30" in length. The two opposite faces of the pad are vulcanized or otherwise adhered to 1 ½" steel plates to provide an assembly weighing approximately 3000 lbs. The steel plates are bolted in place so as to rigidly interconnect with the support column and foundation. Such isolator is capable of absorbing substantial shear loads that could translate into shear displacements of up to about 12".

The drawings illustrate preferred embodiments of the fire barrier system of the present invention in place about a base isolator as described above. Additionally, various components utilized in the system are individually shown in order to reveal details of their structure and their interrelationship with one another.

FIG. 1 is a cross sectional view showing a preferred embodiment of the fire barrier system of the present invention installed about a base isolator 12. The base isolator is shown inserted between the upper portion 14 of a vertical support column and the lower portion 16 of such column. Alternatively, the bottom of the isolator may be attached directly to the building's foundation. The isolator itself consists of an elastomeric core 18 affixed to top plate 20 and bottom plate 22, the elastomer being securely adhered to the two steel plates, such as by vulcanization, so as to permanently join these elements together. The steel plates 20 and 22 are, in turn, joined to the column such as by bolting to flanges 24, 26 whereby such interconnection mechanically links top 14 and bottom 16 portions of the column.

The isolator is protected by a combination of insulative components, including inner blanket panels 28, outer wrap element 30, skirt 32, insulative shelf members 34, and packing 36. Upper tray 38 and lower tray 40 are formed of 18 or 20 gauge galvanized steel and are affixed to the adjacent steel plate of isolator 12 by the grasping action of Z-clips 42 which are attached to the tray pieces with sheet metal screws or pop rivets. FIG. 2 illustrates a corner piece 39 that is utilized in the assembly of both the upper and lower tray pieces. Each corner piece slideably receives the ends of adjacent tray pieces 38 or 40 to facilitate assembly and accommodate variations in the lengths of the individual tray pieces. Sheet metal screws or pop rivets are used to fasten the pieces together. Insulative material 36 such as gypsum based fire proofing material available under the trade name of MONOKOTE MK-6 is packed in and around the base of column 14, as well as the top of column 16 to a depth of at least 3" in order to protect the isolator from above and below. Inner blanket panel 28 is attached to tray 38 by its top edge so as to provide an air gap 33 between the individual panels and the isolator. Sheet metal screws or pop rivets are extended through angle bracket 44, through flap 52, and into tray 38 to hold the panels in place. A plurality of such blanket panels are interfitted about the entire isolator so as to afford protection from all angles. Outer wrap element 30 is attached to tray 38 so as to maintain an air gap of about 2" between it and the inner panels and extends about the entire isolator. Insulative shelf members 34 are affixed to lower tray 40 and extend radially outwardly about the entire isolator. Both the blanket panels 28, as well as the wrap element 30 slideably engage the top surface of the shelf members. A wiper bead 46 is attached to the lower edge of wrap element 30 to ensure that a seal is maintained with the shelf members at all times. Skirt 32 is affixed to tray 40 and extends about the entire isolator to further protect the isolator from the intrusion of heat and flames from below.

FIG. 3 illustrates the manner in which multiple blanket panels 28 are joined with one another. The illustration shows four identical blanket panels 28 arranged in a square configuration. A different blanket configuration would, of course, be necessary in order to accommodate an isolator with a different dimensional configuration. Each blanket panel includes a flap 48 extending from one edge thereof and a second flap 50 affixed to the outer surface of such panel. Upon arranging such panels adjacent to one another as shown, each complementary set of flaps are affixed to one another using stainless steel lacing wire. Additionally, an upper flap 52 extends from the outwardly facing outer edge of each panel to facilitate its attachment to tray 38, by capture between the tray and angle bracket 44.

FIG. 4 reveals the internal structure of the blanket panels. The panel consists of an outer skin 54 formed of silicone impregnated fiberglass fabric and eight layers 56 of ½" thick 8 pcf ceramic fiber insulation sandwiched therebetween. Heavy fiberglass thread ties 58 extend through the interior of the panel and are attached to washers 59 disposed on opposite surfaces of the blanket panel in order to maintain the internal structure in tact. Tab 48 is shown as formed by a fold of outer skin, while flap 50 is attached to the outer skin preferably by stitching 60 using stainless steel wire.

Figure 5:
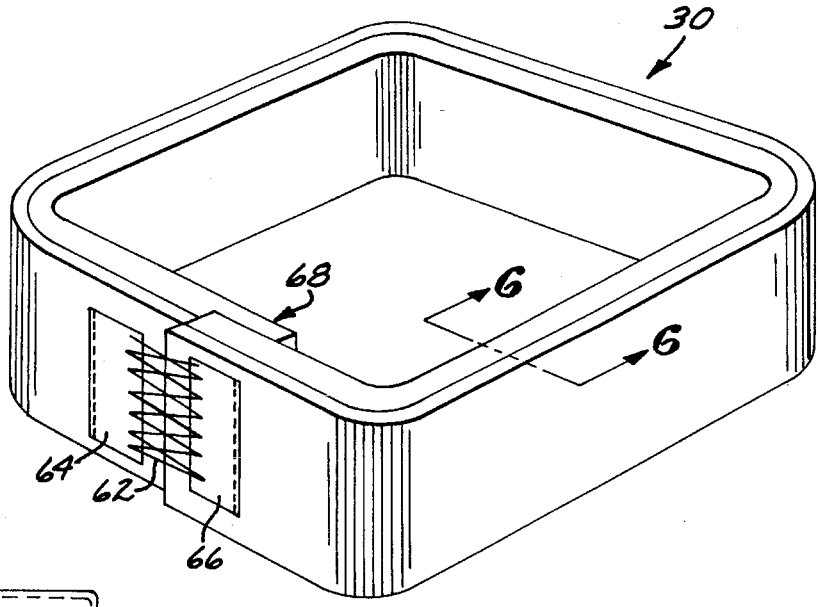
FIG. 5 is a perspective view of the outer wrap element.

FIG. 5 illustrates outer wrap element 30. Such component consists of a one piece structure that extends about the isolator wherein its leading edges are overlapped with one another and held in place by stainless steel lacing 62 extending between flaps 64 and 66. Each flap is formed of fabric material woven of alumina-boria-silica fibers available under the trade name of NEXTEL which is sewn to the outer surface of the wrap element using stainless steel thread. Approximately two inches of overlap (68) between the two edges of the wrap element is preferred. The skirt 32 extending below the isolator is similar in configuration and attached to tray 40 via a first flap extending from its top edge and a second flap extending from its bottom edge.

Figure 6:
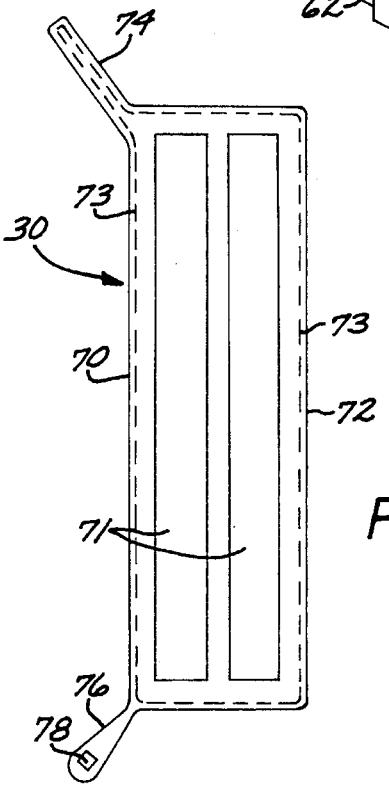
FIG. 6 is an enlarged cross sectional view of the outer wrap element taken along lines 6—6 of FIG. 5.

FIG. 6 illustrates the internal structure of the wrap element wherein an outer skin 70 encloses two layers 71 of ½" thick 8 pcf ceramic fiber insulation. The enclosing skin is silicone impregnated, while the outer side, or hot side 72, is aluminized. A fold of outer skin 74 is positioned adjacent the top inner edge of the wrap element and is used to attach the wrap element to tray 38 via sheet metal screws or pop rivets. Wire mesh 73 is incorporated in the structure as shown. A fold of outer skin near the inner edge of the base of the wrap element encapsulates a bead 78 of ½" thick 8 pcf ceramic fiber insulation to form a wiper bead 76. Except for its lack of a wiper bead, skirt 32 is of similar construction.

Figure 7:
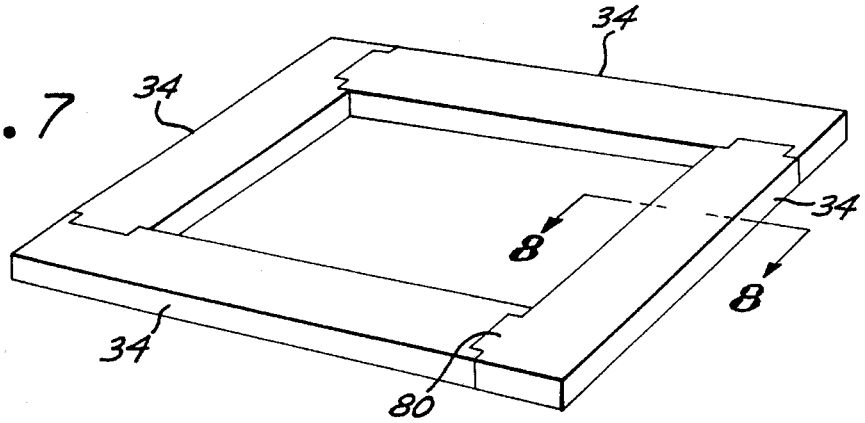
FIG. 7 is a perspective view of four insulative shelf members interfitted to one another.
Figure 8:
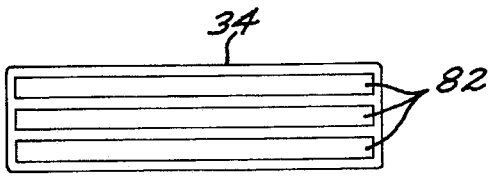
FIG. 8 is an enlarged cross-sectional view of a shelf member taken along lines 8—8 of FIG. 7.

FIG. 7 is a perspective view of the assembly of shelf members 34. Each shelf member is joined to tray 40 using silicone caulk. Alternatively, each shelf member may include a flap 80 having one half of a hook and loop fastener affixed to its bottom surface, while the overlapped portion of the top surface of the adjacent shelf member 34 has the complementary portion of the hook and loop fastener attached thereto. FIG. 8 shows the insulative shelf member 34 in cross section wherein an outer skin of silicon impregnated fiberglass fabric encloses three layers 82 of ½" thick 8 pcf ceramic fiber insulation.

Figure 9:
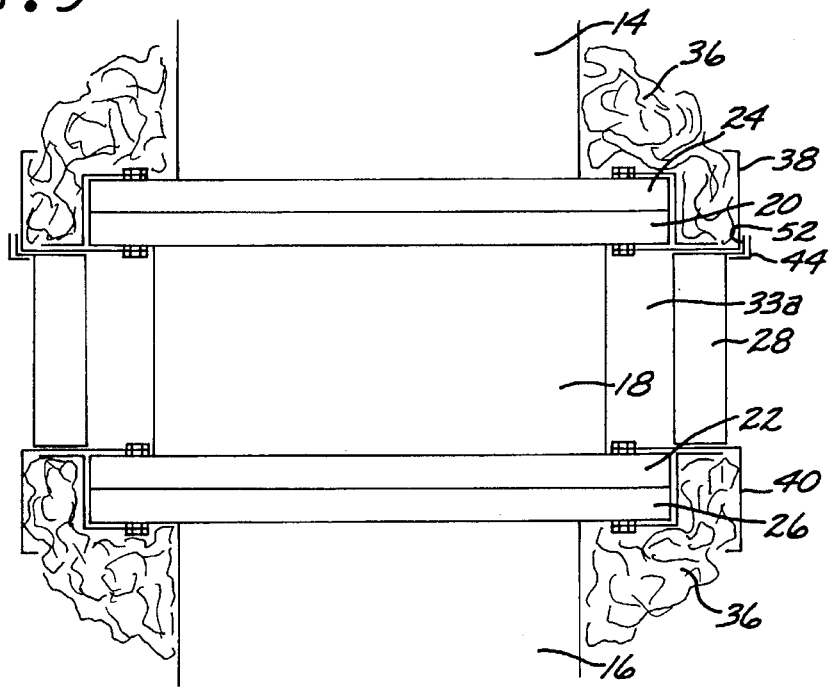
FIG. 9 is a Cross-sectional view illustrating an alternative embodiment of the present invention.

FIG. 9 illustrates an economical alternative embodiment wherein the insulative outer wrap element, skirts, and the insulative shelf components have been deleted. The blanket panels are dimensioned to maintain sealing but slideable contact directly with the top surface of tray 40. The blanket panels 28 are moved further outwardly as compared to the embodiment shown in FIG. 1 so as to increase the air gap 33*a* between the panel and isolator. Bracket 44 is flipped over and captures flap 52 of panel 28 along the edges of tray 38.

Upon assembly of the various components, as illustrated in FIG. 1, an effective barrier against heat and fire is formed about the base isolator. The reflective character of the aluminized fiberglass fabric on the exterior surface of wrap element 30 and skirt 32 serve to reflect radiative energy, while the insulative nature of the ceramic fiber insulation in the core of the outer wrap and inner blanket element 28, as well as air gap 31 and 33, serve to prevent the conduction of heat to the isolator. Additionally, the intimate contact between blanket panels 28 and shelf 34, as well as wiper 46 and shelf member 34, prevent the incursion of heat by convection. In particularly intense fires, the outer skin of outer wrapping may burn away wherein the wire mesh continues to hold the wrapping in place.

Upon shear distortion of the isolator, the bottom edge of blanket panels 28, as well as wrap element 46, simply shift across shelf 34 thereby continuing to maintain the integrity of the barriers. None of the individual components are subjected to significant amounts of strain by such distortion as the internal stresses of various components are easily relieved by the slight amount of movement that the lacing and silicone caulked or hook and loop interconnections allow. The barrier system is therefore able to regain its original configuration at the completion of the seismic event to continue to afford protection to the isolator that may very well be threatened by fire caused by the seismic event.

The alternative embodiment shown in FIG. 9 functions in a similar manner and is able to provide sufficient protection in fires of lesser intensity and/or of shorter duration. The single blanket barrier and air gap are relied upon to provide thermal protection, while such configuration is equally capable of accommodating shear displacements of the isolator.

While a particular form of the invention has been illustrated and described, it will also be apparent to those skilled in the art that various modifications can be made without departing from the spirit and scope of the invention. Accordingly, it is not intended that the invention be limited except by the appended claims.

What is claimed is:

1. A fire barrier system for a base isolator, comprising:

an isolator disposed in line with a building's vertical support member in order to reduce the transfer of seismic loads therethrough;

a plurality of insulative components disposed about said isolator configured so as to shield said isolator from the heat;

means for interconnecting said components to one another and to said isolator so as to allow sliding movement between the components and between the components and the isolator during distortion of the isolator while maintaining an effective barrier against the transfer of heat thereto.

2. The fire barrier system of claim 1, wherein said insulation components compromise:

an insulative shelf extending radially ouwardly from adjacent the bottom of said isolator; and an insulative barrier suspended from adjacent the top of said isolator radially spaced therefrom and disposed to sweepingly engage said shelf.

3. The fire barrier system of claim 2 wherein said insulative barrier comprises a plurality of blanket panels arranged in an abutting relationship to one another.

4. The fire barrier system of claim 3 wherein each of said blanket panels includes two flaps extending therefrom and wherein said flaps from adjacent panels are laced together.

5. The fire barrier system of claim 3 wherein each of said blanket panels comprises an outer skin of silicone impregnated fiberglass fabric enveloping a plurality of layers of ceramic fiber.

6. A fire barrier system for a base isolator, comprising:

an isolator disposed in line with a building's vertical support member in order to reduce the transfer of seismic loads therethrough;

an insulative shelf extending radially outwardly from adjacent the bottom of said isolator;

an inner insulative barrier suspended from adjacent the top of said isolator and disposed to sweepingly engage said shelf; and an outer insulative barrier suspended from adjacent the top of said isolator and disposed to sweepingly engage said shelf whereby said shelf, said inner barrier and said outer barrier continue to maintain an effective barrier against the transfer of heat to the isolator during distortion of the isolator.

7. The fire barrier system of claim 6 wherein said inner insulative barrier comprises a plurality of blanket panels arranged in an abutting relationship to one another.

8. The fire barrier system of claim 7 wherein each of said blanket panels includes two flaps extending therefrom and wherein said flaps extending from adjacent panels are laced together.

9. The fire barrier system of claim 7 wherein each of said blanket panels comprises an outer skin of silicone impregnated fiberglass fabric enveloping a plurality of layers of ceramic fiber.

10. The fire barrier system of claim 6 wherein said outer insulative barrier comprises single length of barrier material wrapped about said isolator.

11. The fire barrier system of claim 10 wherein opposite ends of said outer insulative barrier overlap one another and are held in place by flaps extending therefrom that are laced together.

12. The fire barrier system of claim 10 wherein said outer insulative barrier comprises an outer skin of fiberglass fabric enveloping a plurality of layers of ceramic fibers wherein said skin is aluminized on all outward facing surfaces.

13. The fire barrier system of claim 10 wherein the bottom edge of said outer insulative barrier includes a wiper bead for sealingly engaging said insulative shelf in a sweeping manner.

14. The fire barrier system of claim 13 wherein said wiper bead comprises a fold of said outer skin encasing a length of a ceramic fiber bundle.

15. The fire barrier system of claim 6 wherein said insulative shelf comprises a plurality of panels arranged about said isolator in an abutting relationship relative one another.

16. The fire barrier of claim 2 further comprising a packing of insulative wool disposed above said isolator and adjacent said vertical support column and below said insulative shelf.

* * * * *

UNITED STATES PATENT AND TRADEMARK OFFICE

CERTIFICATE OF CORRECTION

PATENT NO. : 5,546,711

DATED : August 20, 1996

INVENTOR(S) : Paul S. Heller

It is certified that error appears in the above-identified patent and that said Letters Patent is hereby corrected as shown below:

Column 6, line 60, delete "2", insert --6--.

Signed and Sealed this

Twelfth Day of November, 1996

*Attest:*

BRUCE LEHMAN

*Attesting Officer*

*Commissioner of Patents and Trademarks*